US005868257A

United States Patent [19]

Stadtmuller

[11] Patent Number: 5,868,257

[45] Date of Patent: Feb. 9, 1999

[54] MAGNETIC SEPARATION SYSTEMS

[75] Inventor: Adam Antoni Stadtmuller, Chalfont St. Peter, Great Britain

[73] Assignee: Carpco, Inc., Jacksonville, Fla.

[21] Appl. No.: 535,021

[22] PCT Filed: May 7, 1993

[86] PCT No.: PCT/GB94/00989

§ 371 Date: Apr. 1, 1996

§ 102(e) Date: Apr. 1, 1996

[87] PCT Pub. No.: WO94/26417

PCT Pub. Date: Nov. 24, 1994

[30] Foreign Application Priority Data

May 7, 1993 [GB] United Kingdom ..... 9309426.6

[51] Int. Cl.[6] ..... B03C 1/00

[52] U.S. Cl. ..... 209/213; 209/215; 209/224; 209/232

[58] Field of Search ..... 209/213, 215, 209/223.1, 224, 232; 210/222, 223

[56] References Cited

U.S. PATENT DOCUMENTS 4,054,513 10/1977 Windle ..... 209/223.1 X
4,110,222 8/1978 Watson ..... 209/223.1 X
5,076,914 12/1991 Garaschenko et al. ..... 209/223.1 X

FOREIGN PATENT DOCUMENTS 1599824 10/1981 United Kingdom ..... B01D 35/06

OTHER PUBLICATIONS

IEEE Transactions on Magnetics, vol. 17, No. 6, Nov. 1981, New York US pp. 3299–3301, P.W. Riley et al.

Book: Magnetic Methods For the Treatment of Minerals, 1987, Elsevier, Amsterdam, NL, pp. 201–203, J. Svoboda.

*Primary Examiner*—David H. Bollinger
*Attorney, Agent, or Firm*—Arthur G. Yeager

[57] ABSTRACT

A magnetic separator for separating magnetisable particles from a slurry is described. The separator includes means for establishing a magnetic field (10) in a separation zone. At least one separation chamber (12) with an inlet and outlet containing a fluid permeable magnetizable separating packing material, and, at least one compensating chamber (4) containing a magnetizable compensating packing, are linked and are movable such that movement of the separation chamber or chambers into the separation zone results in movement of the compensating chamber or chambers out of the separation zone and vice-versa. The magnetization characteristics and/or the demagnetization factors of the separating and compensating packings are substantially the same.

13 Claims, 4 Drawing Sheets

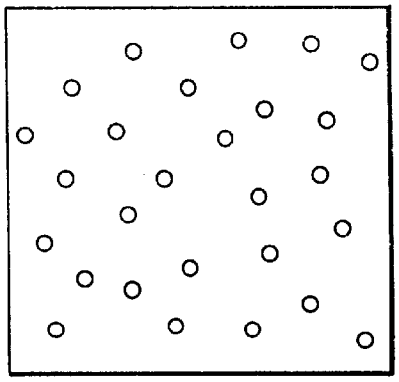
FIG.6D
FIG.6
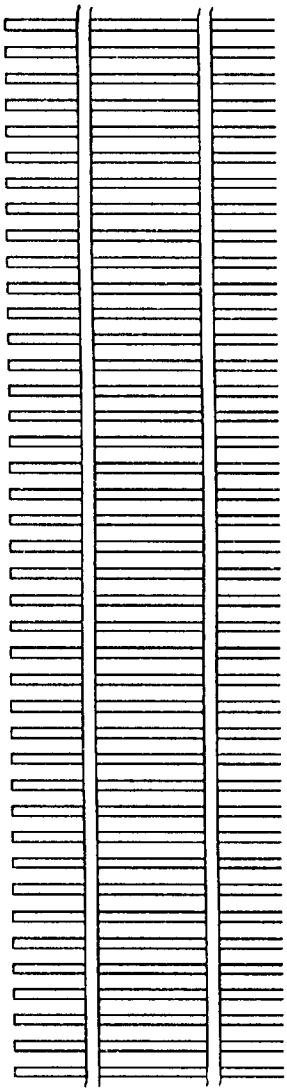
FIG.6A
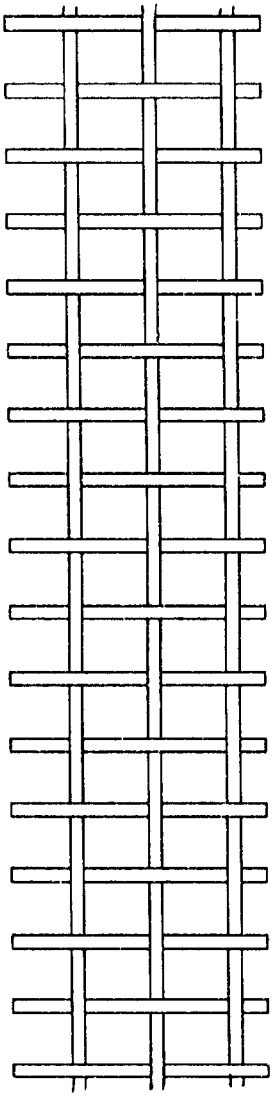
FIG.6B
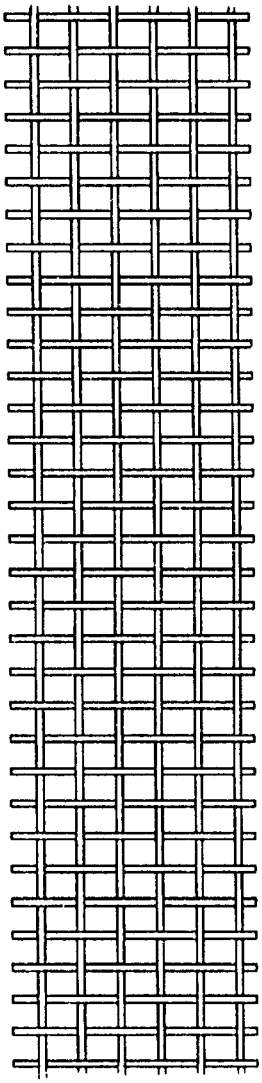
FIG.6C

MAGNETIC SEPARATION SYSTEMS

This invention relates to magnetic separation devices, in particular to the type of device in which magnetic particles are removed from a stream of material by feeding the stream on or through stationary magnetic material, the magnetic particles being held or "trapped" by the magnetic material and therefore extracted from the stream.

One form of magnetic separation device which functions by magnetic particle entrapment is generally referred to as a High Gradient Magnetic Separator or HGMS. An HGMS comprises a canister containing a liquid-permeable packing of magnetizable material between the canister inlet and outlet. The packing material may be paramagnetic or ferromagnetic and may be in particulate or filamentary form, for example, it may comprise wire wool, wire mesh, knitted mesh or steel balls. The packing may be in the form of a single block which essentially fills the canister or it may be in other forms, for example, concentric cylinders or rectangular plates. The term "matrix" is generally employed to refer to the packing and this is used, in the case where the packing is divided into a number of elements, by some in the industry to refer to the individual elements and by others to refer to the totality of the packing. The term will be employed herein in the latter way.

The canister is surrounded by a magnet which serves to magnetise the matrix contained therein, the magnet generally being arranged to provide a magnetic field in the direction of the cylindrical canister axis. With the matrix magnetized, a slurry of fine mineral ore, for example, clay dispersed in water, is fed into the inlet of the canister. As the slurry passes through the canister the magnetizable particles in the slurry are magnetized and captured on the matrix. Eventually, the matrix becomes substantially filled with magnetisable particles and the rate of capture decreases so that the quantity of magnetizable particles in the treated slurry leaving the outlet of the canister reaches an unacceptably high level. The slurry feed is then stopped and the canister rinsed with water to remove all non-magnetic material from the matrix. The magnetic field acting on the matrix is reduced to a sufficiently low value to enable the magnetic material to be washed off the matrix elements with a high speed stream of water.

The reduction in the magnetic field may be achieved by de-energizing the magnet. HGMS systems operated in this way are referred to as switched HGMS systems. With large diameter canisters, slow slurry velocities and fairly infrequent flushing operations switched HGMS systems are relatively efficient. However with stronger magnets having higher magnetic fields, processing velocities can be increased giving an overall decrease in cycle time. The flushing operation then becomes an increasingly large element of the cycle time. The cycle efficiency drops owing to wasted magnet time which can be significant even with a magnet capable of fast field reduction and subsequent increase, referred to as a "fast ramp" magnet. The percentage of time during which separation is taking place, known as a the "duty factor" of the separator, is typically less than 50%. Further, the ramping of the magnet causes increased heating of the coil by eddy currents which must be compensated for by providing larger and more expensive cooling. Ramping increases power consumption and, if it is to be fast, necessitates a large and expensive power supply.

These disadvantages can be overcome by use of a process in which the saturated matrix containing canister is pulled out of the magnet into a region of low field where flushing takes place. At the same time a second canister is moved into the field so that separation can be carried out there during flushing of the first canister. The only "dead time" is during movement of the canisters and this can be made very short so that the duty factor of the separator can approach 100%. An HGMS system operated in this way is referred to as a reciprocating canister HGMS or RCHGMS.

Removal of a canister containing a ferromagnetic matrix out of a high magnetic field region requires considerable force. Accordingly, a method has developed which involves the use of compensating elements (or canisters) which reduce the net force required by maintaining a constant amount of ferromagnetic material in the magnetic field region. A practical embodiment of such a method is illustrated in FIG. 1. In the arrangement, two separating canisters 2 are sandwiched between three compensating canisters 4, the canisters 2 and 4 defining together a reciprocating matrix train 5 which is moved by a linear actuator 6. The arrangement allows a first separating canister 2 to be actively engaged in the separation process whilst the second separating canister 2 is outside the high field region created by the magnet 8. The second separating canister can therefore be flushed clean of previously captured magnetic particles. The reciprocating matrix train 5 is periodically moved such that the regenerated separating canister 2 enters the high field region whilst the previously active separating canister 2 is moved out for regeneration. It is this cyclical back and forward movement which gives rise to the name reciprocating canister HGMS.

The magnet 3 shown in FIG. 1 is a cylindrical superconducting magnet operating at cryogenic temperatures. It comprises a super-conducting coil 8*c* which has an electrical supply 8*b* and is encased in a vacuum can 8*c* and an iron yoke 8*d*.

Whenever a magnetically susceptible material is placed with a magnetic field, the magnetic flux is changed by this material since the specimen is being magnetized. The flux outside this material can either be enhanced by the presence of the specimen (para- and ferromagnetics) or diminished by it (diamagnetics). This can be explained by the formation of magnetic poles at the surface of the material which contribute to the outside flux.

The presence of these magnetic poles, however, changes the magnetic flux inside the material as well. For ferro- and paramagnetic materials the flux caused by the magnetization of the specimen (i.e. the formation of magnetic poles on its surface) counters the outside flux. The net flux through the specimen is thus diminished, i.e. the specimen is being de-magnetized somewhat. This happens if the direction of magnetization has a component normal to the surface of the specimen. It is thus shape-dependent. The amount of the diminution of the internal magnetic flux is described by the demagnetization factor. This factor is zero for magnetically non-susceptible specimen and one for a specimen the surfaces of which are normal to the magnetization direction. Usually, the demagnetization factor lies between zero and one. When the demagnetization factors are measured in all three directions of the sample, the sum of these individual factors must add up to one.

If an axially magnetized rod has magnetized end surfaces that are big relative to the rod length, the demagnetization factor would be high, closer to one. If the end areas are small compared to the rod length, the demagnetization factor would be small, closer to zero. IN a toroid that is being magnetized in a way that the flux lines are everywhere parallel to the toroid surface, the demagnetization factor is zero (toroidal transformer). A spherical specimen has a demagnetization factor of ⅓, this factor for a long stretched wire is zero when magnetized along its axis and ½ when magnetized perpendicular to its axis.

If a magnetically susceptible material (say a ferromagnetic specimen) is exposed to a magnetic flux, B, and if that field changes over the dimensions of the material, i.e. it exhibits a flux gradient, $$\frac{dB}{dx},$$

then the specimen would experience a force that would pull it towards the location of greatest field gradient. This force can be described by $$F = \frac{1}{\mu_0} M \frac{dB}{dx} V,$$

where V is the volume of the specimen, $\mu o$ is the permeability of free space and M is the magnetization of the specimen. The magnitude of this magnetization, and thus the force on the specimen, is directly influenced by the demagnetization factor of the specimen. If, for example, the specimen is a sphere, the magnetization of it would be one third less than its maximum magnetization. The attractive force on a sphere is thus one third less than the attractive force on a thin, axially magnetized wire (demagnetization factor zero) of the same volume and material as the sphere and exposed to the same magnetic field gradient.

FIG. 2 shows a somewhat simplified field profile along the bore of a cylindrical HGMS magnet such as that illustrated in FIG. 1. The Y axis represents the field, whilst the X axis represents the distance along the cylindrical axes of the magnet. The force on a ferromagnetic object placed in a non-uniform magnetic field is in the direction of maximum field. Thus, the force on ferromagnetic material on the left hand side of the magnet in the field decay region can be counter-balanced by an equal and opposite force experienced by ferromagnetic material on the right hand side in the field decay region.

Various arrangements have been proposed with the object of providing balanced forces on all parts of a matrix train as it is reciprocated.

British Patent 1599824 describes a separator with a compensating canister which contains a series of circular discs of ferromagnetic material, preferably soft iron, arranged such that their faces are perpendicular to the axis of the cylindrical magnet. This arrangement, however, has a number of disadvantages.

Firstly, the magnetic behaviour of soft iron can be substantially different to that of commonly used matrices, the material of which is generally ferromagnetic stainless steel. The differences exist both in the slope and saturation of magnetization. A simple mass balance to give the same average density of soft iron plates as ferromagnetic matrix will thus not necessarily result in acceptable magnetic force balancing.

Secondly, the plates which may have a thickness of up to 12 mm will experience significant eddy currents. Regardless of the effectiveness of the magnetic balance, an unnecessarily high force will therefore be required for reciprocation.

Thirdly, and most seriously, the plates are described as having a typical thickness to diameter ratio of 0.01. The demagnetization factor for plates of this aspect ratio normal to the magnetic flux is very close to unity. Common forms of matrices, for example, matrices comprising solid spheres or stainless steel wool fibres with their axis normal to the magnetic flux lines, exhibit demagnetization factors of approximately ⅓ and ½ respectively. Consequently, before magnetic saturation is reached, the force experienced at the plates will be significantly lower than that experienced by the separating matrix.

It is possible to counteract the last described effect in the two outer compensating canisters of a matrix train of the type illustrated in FIG. 1. These canisters approach the high field region from a specific direction and have a well defined stop position. Compensation can therefore be achieved by appropriate adjustment of the mass distribution across the canisters. This cannot however be done for the central compensating canister.

In an alternative proposed arrangement, which is intended to take into account the fact that the ratio of the matrix volume to the overall canister volume can vary is described in Czechoslovakian Patent Application 224749. In this arrangement, a series of long rods of ferromagnetic material are arranged in the compensating canisters with their axes parallel to the coil axis. The rods are removable to allow simple adjustment of the mass of the compensating ferromagnetic material to take into account the matrix filing density of the separating canisters. The arrangement however fails to give suitable balancing for two reasons. Firstly, the demagnetization factor of the rods is substantially different to that of the majority of common matrices. Secondly, the design fails to take into account the radial variation of the magnetic field of a solenoidal magnet. The field gradient of such a magnet is higher at the outer annulus than along the central axis so that the axial magnetic force experienced by a fixed mass of ferromagnetic material at the outer cylindrical region is greater than if it were at the same radial plane by closer to the axis.

A RCHGMS is described in a paper by P. W. Riley et al: "A reciprocating canister superconducting magnetic separator", pages 3299 to 3301, IEEE Transactions on Magnetics, Vol. 17, No. 6, Nov. 1981, New York, USA. The canister train includes an active canister with a ferromagnetic stainless steel wool packing divided, and thereby supported, by spaced cups with perforated bases. The train has two dummy or compensating canisters of identical form except that no feed or return ports are provided. The paper describes the desirability of matching the mass of material entering and leaving the magnetic field at any time. The near total identity between the active and dummy canisters in the described train will achieve this mass matching.

A magnetic separator for separating magnetizable particles from a slurry, in accordance with the invention, comprises means for establishing a magnetic field in a separation zone, at least one separating chamber with an inlet and outlet containing a fluid permeable magnetizable separating packing, and, at least one compensating chamber containing a magnetizable compensating packing, the chambers being moveable and linked such that movement of the separation chamber(s) into the separation zone results in movement of the compensating chamber(s) out of the separation zone and vice versa wherein the magnetization characteristics and/or the demagnetization factor of the separating and compensating packings are substantially the same wherein a potting medium is provided in the compensating chamber(s) to support the compensating packing therein.

The compensating packing comprises ferromagnetic material and it should have closely matched magnetization characteristics to the separating packing. In other words, the magnetization curve and the hysteresis loop of the compensating packing material should be similar to that of the separating packing material. Further, the shape and orientation of the ferromagnetic compensating packing should be such that its demagnetization factor is equivalent to that exhibited by the separating packing. Above saturation point, the mass and demagnetization factors are determinative. Matching these will not be effective if the magnetic field is such that neither packing is saturated or only one is.

Support means are provided for the compensating packing in the form of a potting medium such as epoxy resin. This prevents destruction and consequent ineffectiveness of the packing if relatively fragile, for example wire wool or fine mesh, and vulnerable to damage by multiple reciprocations of the compensation chamber. The potting medium supports the compensating packing providing a mechanically robust and resilient body which will not degrade as a result of repeated reciprocation.

The density distribution of the compensating packing material and the separating packing material across the respective chambers should be the same.

The separating chamber(s) and compensating chamber(s) should preferably be cylindrical in which case the density distribution of the compensating packing material and the separating packing material throughout corresponding cylindrical regions should be the same.

The compensating packing may be the same as the separating packing but advantageously the compensating packing material is of the same general form but has relatively larger dimensions than the separating packing material. For example, with a wire wool type separating packing, the compensating chamber(s) can be filled with a much coarser grade of wool. Similarly, for a separating packing of ferromagnetic balls, the compensating chamber (s) can be filled with larger diameter ferromagnetic balls. The demagnetizing factor should, in all cases however, be well matched.

Alternatively the compensating packing can comprise a series of discs of ferromagnetic material arranged to exhibit the same magnetization curve and demagnetization factor as exhibited by the separating packing. For example, with a wire wool separating packing, the compensating packing can be formed of discs made from woven mesh or expanded metal. The discs should be rigidly held between support plates of non-magnetic, and preferably electrically non-conducting, material. The complete compensating chamber assembly of ferromagnetic discs and support plates must be sufficiently rigid to withstand magnetic forces without deformation. The support plates which can be in the form of spacer discs can be made from any suitable material including rigid or near-rigid plastics, ceramics, wood or a composite of these materials. A particularly suitable form for the support discs is discs of compressed wood.

The cross-sectional area of the compensating packing transverse to the magnetic field at any point along the axis of the compensating chamber(s) preferably should be the same as that of the separating packing at a corresponding axial point along the separating chamber(s).

Alternatively, if the transverse cross-sectional areas must differ, e.g. because of a need to provide feed pipes through part of the separating chamber(s), then a suitable adjustment of the compensating packing mass at points across the transverse cross-sectional area taking into account the field gradient at the point should be made to generate a force balance between the compensating and separating packing. The calculation of the mass adjustment required is greatly simplified when the packings have the same magnetization characteristics.

The invention will now be further described by way of example with reference to the accompanying drawings in which:

FIG. 6 shows various forms of packing material suitable for use with a magnetic separator in accordance with the invention.

Figure 1:
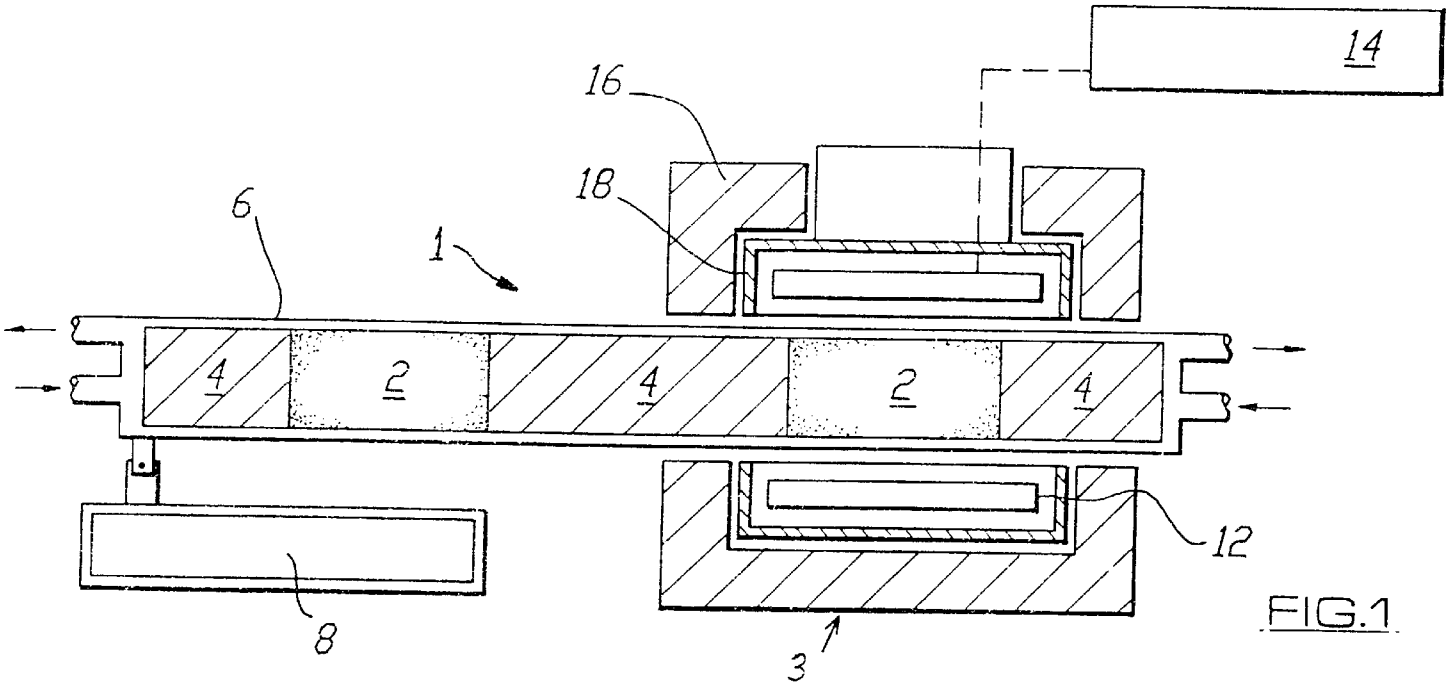
FIG. 1 is a schematic view of a known magnetic separator.
Figure 2:
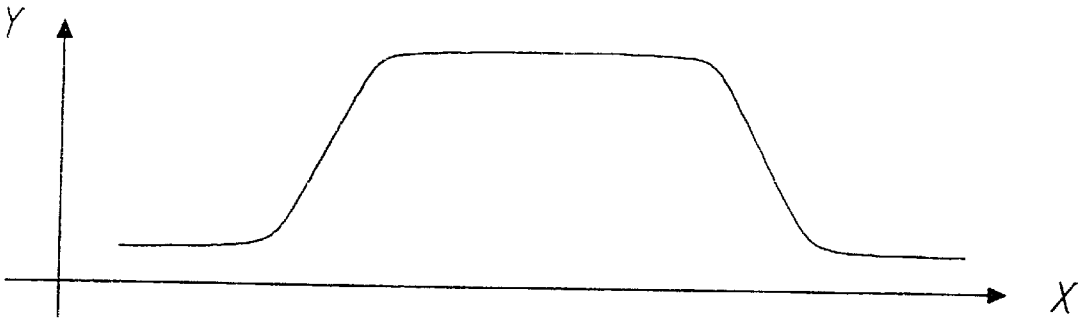
FIG. 2 is a simplified field profile along the bore of a HGMS magnet.

A magnetic separator, in accordance with the invention, may be in the form illustrated in FIG. 1 and, therefore, like numerals will be used for like parts. Thus, a suitable separator has two separating chambers comprising separating canisters 2 and three compensating chambers comprising compensating canisters 4. The axial length of the outer compensating canisters 4 is less than that of the central compensating canister 4. The linear actuator 6 need only provide a relatively small reciprocating force due to the matching of the separating packing and compensating packing and consequent reduced restraining force encountered on reciprocation.

Figure 3:
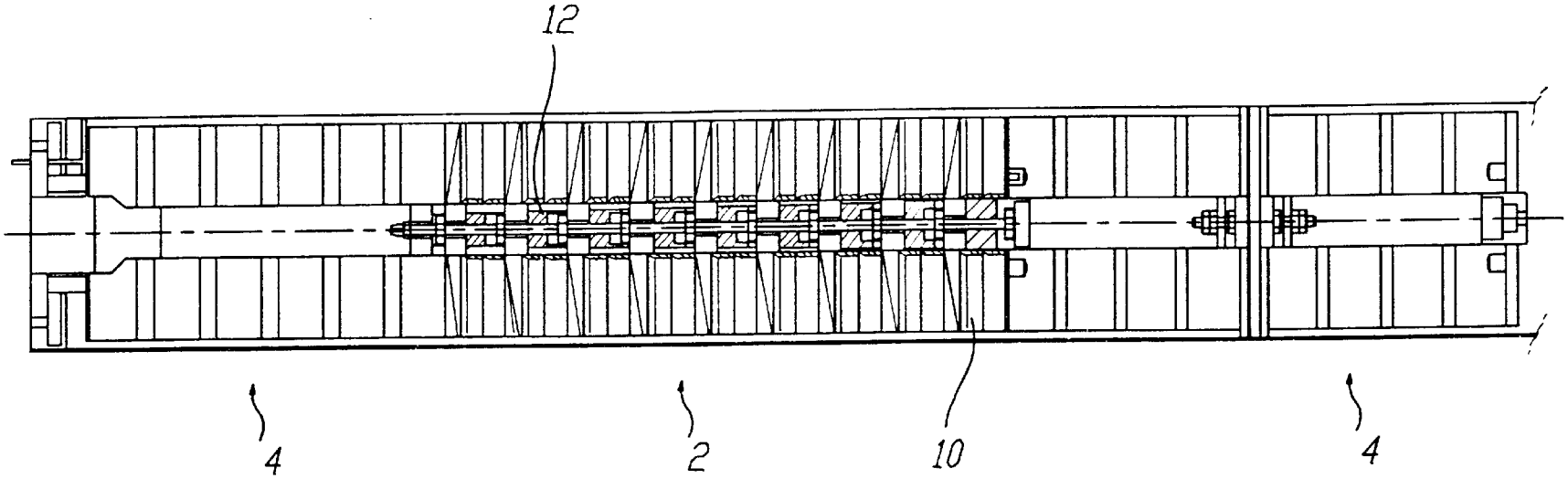
FIG. 3 is a side view of part of a reciprocating matrix train of a magnetic separator in accordance with the invention.

FIG. 3 shows the left-hand end, as viewed in FIG. 1, of the reciprocating matrix train 5 thereof. The separating chambers 2 illustrated is in the form described in International Patent Application No. WO92/16301. It comprises a number of matrix elements 10 positioned axially one above the other within the chamber 2 and flow separation means 12 for dividing a stream of fluid, fed from the left to the right as viewed in the Figure, into one or more portions and directing each portion axially through a matrix element 10.

Figure 4:
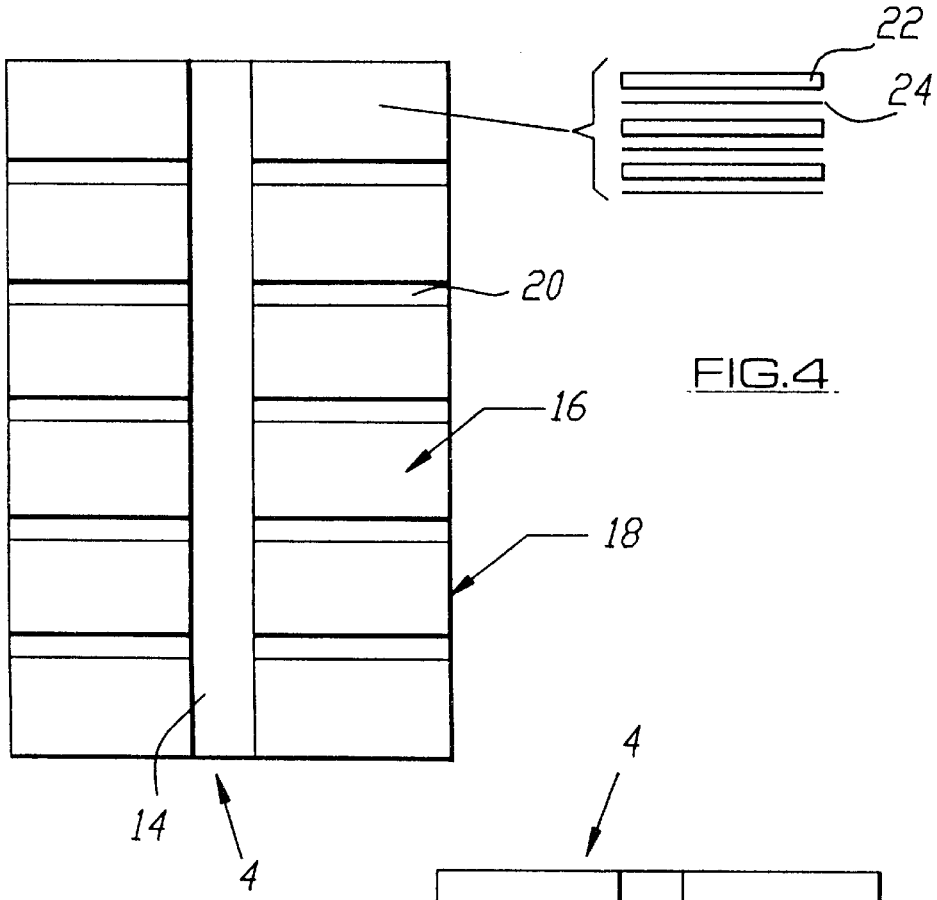
FIG. 4 shows one embodiment of a compensating chamber of the reciprocating matrix train of FIG. 3.

The compensating chamber 4 shown in FIG. 4 has a central bore 14 for the feed of material to be separated or for the return of separate product. A compensating packing 16 is provided around the central bore 14 and is enclosed by an outer skin 18. The packing 16 is divided into a number of sections or elements by non-magnetic spacer discs 20. The material of these discs 20 is preferably also water-resistant and electrically non-conductive. Suitable materials include rigid or semi-rigid plastic materials, ceramics, wood or a composite of these materials. The compensating packing comprises alternating layers of magnetic stainless steel mesh discs 22 and non-magnetic spacer discs 24. Again the discs 22 will be arranged to exhibit the same magnetisation curve and demagnetisation factor as is exhibited by the separating packing.

Figure 5:
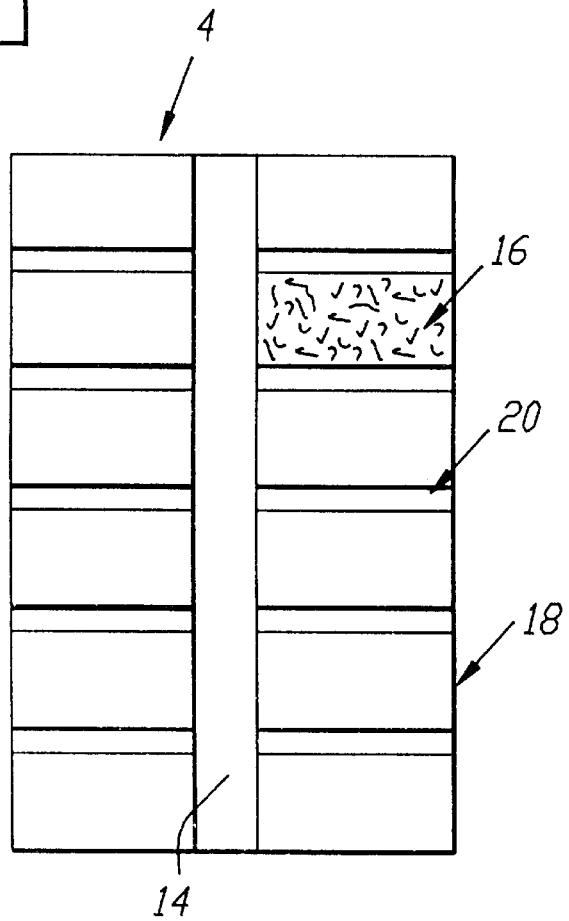
FIG. 5 shows an alternative embodiment of the compensating chamber.

In the embodiment of FIG. 5 the packing 16 comprises stainless steel wire wool encased in resin. Again the packing 16 is divided into a number of sections by spacer discs 20. The spacer discs in both the embodiments of FIGS. 4 and 5 support and rigidify the packing 16 whilst the resin employed in the embodiment of FIG. 5 prevents mechanical degradation of the stainless steel wire wool due to repeated magnetic stresses as the matrix train 6 is reciprocated past the magnet 3.

FIG. 6 illustrates possible materials for the compensating packing 16 which include screen, FIGS. 6*a*, mesh, FIGS. 6*b* and 6*c*, and expanded metal i.e. perforated metal sheets, FIG. 6*d*. As noted above steel wool may also be used. Whatever material is employed the packing 16 can be in the form of discs as shown in FIG. 4. As appropriate resin or some other potting medium is included to rigidify the magnetic material of the packing in addition or as an alternative to the supporting spacers.

The compensating packing material may be of the same type as the separating packing material. However, for economic reasons the compensating packing material may have larger dimensions. For example, in the case of wire wool the compensating chambers 4 can be filled with a much coarser grade of wool or in the case of ferromagnetic balls, the compensating chambers 4 can be filled with larger diameter balls. In all cases however the demagnetisation factor should be well matched. Further as noted above a potting medium should be employed to ensure that the compensating packing constitutes a mechanically robust body.

In all cases the cross sectional area of the compensating packing along the axes of the compensating chambers 4 should match that of the separating packing. The provision of feed channels and flow dividers such as illustrated in FIG. 3 may prevent the area from being matched. In this case the compensating packing mass is adjusted at a number of points along the axes of the chambers 4 taking into account the field gradient at the point, to generate a force balance between the compensating and separating packings.

I claim:

1. A magnetic separator (1) for separating magnetisable particles from a slurry comprising means (3) for establishing a magnetic field in a separation zone, at least one separating chamber (2) with an inlet and outlet containing a fluid permeable magnetizable separating packing (10), and, at least one compensating chamber (4) containing a magnetizable compensating packing (16) and linked to at least one separating chamber (2), means (8) for moving the linked at least one separating chamber (2) and at least one compensating chamber (4) such that movement of the at least one separating chamber (2) into said separation zone results in movement of the at least one compensating chamber (4) out of said separation zone and vice versa wherein the magnetization characteristics and/or the demagnetization factors of said separating and compensating packings (10, 16) are substantially the same and wherein a potting medium is provided in said at least one compensating chamber (4) to support the compensating packing (16) therein.

2. A magnetic separator as defined in claim 1, wherein said compensating packing (16) comprises ferromagnetic material, the magnetisation characteristics of which are identical or closely similar to those of the separating packing material.

3. A magnetic separator as defined in either claim 1 or claim 2, wherein density distributions of said compensating packing material and said separating packing material across respective said chambers (2, 4) is equal.

4. A magnetic separator as defined in claim 3, wherein said at least one separating chamber (2) and said at least one compensating chamber (4) are cylindrical and said density distribution of said compensating packing material (16) and said separating packing material (10) throughout corresponding cylindrical regions of respective said chambers (2, 4) is the same.

5. A magnetic separator as defined in claim 1, wherein a cross-sectional area of said compensating packing (16) transverse to the magnetic field at any point along the axis of said at least one compensating chamber (4) is the same as that of said separating packing (10) at an equivalent axial point along said at least one separating chamber (2).

6. A magnetic separator as defined in claim 1, wherein at least one point along the axis of said at least one compensating chamber (4) the cross-sectional area of said compensating packing (16) transverse to the magnetic field differs from that of said separating packing (10) at an equivalent axial point along said at least one separating chamber (2) and a corresponding mass differential is provided between said compensating packing (16) and said separating packing (10) to generate a balance between a force on said compensating packing (16) at said at least one point in said at least one compensating chamber (4) and said separating packing (10) at said equivalent point in said at least one separating chamber (2) as said at least one compensating chamber (16) and said at least one separating chamber (2) are moved into and out of the separation zone.

7. A magntic separator as defined in claim 1, wherein said compensating packing material has the same form as said separating packing material.

8. A magnetic separator as defined in claim 7, wherein said compensating packing material has relatively larger dimensions than said separating packing material.

9. A magnetic separator as defined in claim 1, wherein said compensating packing (16) is divided into a plurality of elements (16) axially spaced along said at least one compensating chamber (4), and support plates (20) of nonmagnetic material being positioned between said compensating packing elements (16).

10. A magnetic separator as defined in claim 9, wherein said support plates (20) are formed from the group comprising plastic materials, ceramics, wood and composites thereof.

11. A magnetic separator as defined in claim 9, wherein said at least one compensating chamber (4) is cylindrical and said compensating packing (16) includes a plurality of discs of ferromagnetic material (22), and support plates in the form of spacer discs (24) between adjacent said discs of ferromagnetic material (22).

12. A magnetic separator as defined in claim 11, wherein said discs (24) are formed from the group comprising plastic materials, ceramics, wood and composites thereof.

13. A magnetic separator as defined in claim 1, wherein said compensating packing (16) is formed from the group comprising mesh, matrix, expanded metal, and balls.

* * * * *